US005186099A

United States Patent [19]

Qing et al.

[11] Patent Number: 5,186,099

[45] Date of Patent: Feb. 16, 1993

[54] METHOD OF SAVING SPACE OCCUPIED BY TOILET ROLLS IN TRANSPORTATION AND STORAGE PROCESSES AND RELATED SPECIAL DEVICES

[75] Inventors: Cai Qing, 115 Wenhua Road, Zhengzhou, China;

[73] Assignees: China Henan Light Industrial Products Import and Export Corporation, Zhengzhou, China; Rober Ng, Quarry Bay, Hong Kong; Yi Xiao Guang; Cai Qing, both of Zhengzhou, China

[21] Appl. No.: 853,878

[22] Filed: Mar. 18, 1992

Related U.S. Application Data

[63] Continuation of Ser. No. 453,826, Dec. 21, 1989, abandoned.

[30] Foreign Application Priority Data

Dec. 23, 1988 [CN] China ..... 88108963

[51] Int. Cl.[5] ..... B30B 13/00

[52] U.S. Cl. ..... 100/35; 53/438; 242/1; 242/55.2

[58] Field of Search ..... 100/35, 40, 76, 77, 100/177, 178; 53/436, 438, 437, 529; 72/392, 393; 242/1, 55.2, 68.4

[56] References Cited

U.S. PATENT DOCUMENTS

| | | | |
|---|---|---|---|
| 592,859 | 11/1897 | Barker | 72/392 |
| 864,975 | 9/1907 | Luce | 100/40 X |
| 1,086,946 | 2/1914 | Smith | 242/55.2 |
| 1,515,382 | 11/1924 | Cheesman | 242/55.2 X |
| 1,570,190 | 1/1926 | Williams | 242/55.2 |
| 1,694,954 | 12/1928 | Stack | 53/436 X |
| 1,922,716 | 8/1933 | Robinett | 242/1 |
| 1,924,088 | 8/1933 | Bowles et al. | 242/55.2 |
| 3,292,903 | 12/1966 | Meyer et al. | 72/392 X |
| 4,762,061 | 8/1988 | Watanabe et al. | 100/35 |
| 4,875,328 | 10/1989 | Meyer | 53/529 |
| 4,886,167 | 12/1989 | Dearwester | 206/389 |
| 4,909,388 | 3/1990 | Watanabe | 206/390 X |

FOREIGN PATENT DOCUMENTS

| | | | |
|---|---|---|---|
| 1005992 | 3/1983 | U.S.S.R. | 72/393 |
| 1493794 | 11/1977 | United Kingdom | 72/393 |

*Primary Examiner*—Philip R. Coe
*Assistant Examiner*—Stephen F. Gerrity
*Attorney, Agent, or Firm*—Flehr Hohbach Test Albritton & Herbert

[57] ABSTRACT

A method for substantially saving transportation costs and storage space when transporting and storing toilet rolls. The method comprises the steps of pressing the cylindrical toilet rolls, before transportation and storage, into a flattened shape which reduces the volume occupied by each roll and minimizes the space between adjacent rolls. The next step includes, before usage, inserting a threaded rod into the flattened core, mounting conical pieces on opposite ends of said rod, and screwing one of the conical pieces into the flattened core until the periphery of the core is recovered to the original cylindrical-shape.

3 Claims, 5 Drawing Sheets

METHOD OF SAVING SPACE OCCUPIED BY TOILET ROLLS IN TRANSPORTATION AND STORAGE PROCESSES AND RELATED SPECIAL DEVICES

This is a continuation of application Ser. No. 07/453,826, filed Dec. 21, 1989, now abandoned.

TECHNICAL FIELD

The present invention relates to a method for saving space occupied by toilet rolls in transportation and storage processes, particularly to a method for transforming and compacting the shape of toilet rolls consisting of thin paper sheets rolled onto a plastic core before transportation and storage, to reduce cost of transportation and storage.

BACKGROUND ART

The traditional way for transporting and storing toilet rolls is to keep the rolls in cylindrical form from production of the rolls through transportation, storage and sales down to usage. This shape of toilet roll, because of its relatively large volume, occupies more area in warehouses and transportation equipment, and causes higher transportation and storage costs. From the knowledge of plane geometry, a figure of a given area has its least perimeter when it is a circle. Vice versa, a figure having a given length of perimeter has its largest area when it is a circle. Looking from the way for packing, equilateral triangles, squares, regular hexagons and rectangles all can be arranged in such a way so that no space will be left between the figures. This is not the case with circles. Therefore in order to minimize the space each roll may occupy and the space between the rolls so as to economize the total space the rolls may occupy in warehouses and transportation equipment, it is necessary to discard the cylindrical shape. Considering the problem of technique, it would be most profitable to transform the shape as near to a rectangular cross section as possible.

OBJECTS OF THE INVENTION

It is an object of the invention to provide a method for saving space occupied by toilet rolls in transportation and storage process so as to reduce cost of transportation and storage.

It is another object of the invention to provide a special device for pressing the toilet rolls into a shape similar to a rectangle so as to facilitate the transportation and storage.

It is a further object of the invention to provide a device for recovering the cylindrical shape from the pressed toilet rolls so as to meet the traditional usage of the toilet rolls.

Although certain embodiments of the invention have been described herein in detail, the invention is not to be limited only to such embodiments, but rather only by the appended claims.

DISCLOSURE OF THE INVENTION

The technical measures adopted by the present invention are: before transportation and storage, the cylindrical toilet rolls are pressed either manually or by machine so that the cross section of the roll becomes the shape similar to a rectangle and the periphery of the core becomes two flat walls touching each other or getting very close. The pressed rolls are then properly piled up and compactly packed, ready for transportation and storage.

Transporting and storing toilet rolls that have been transformed in shape according to the present invention may save up to 44% of the packing and storage space. In other words, the carrying capacity of the transportation equipment and storing capacity of the warehouses may be raised 80% roughly so that the costs may be reduced substantially. Toilet paper is one of the export products of China. The amount exported annually is quite significant. Take as an example of the export of toilet rolls from Central China (e.g. Lhengzhou) to Hong Kong, a savings of more than 150 yuan per ton may be realized for exports carried on domestic railway transport alone. At the same time it would be a relaxation of tension on the demand for more railway rolling stock. Also, the toilet paper is pressed rather tightly together so that the roll would not get loose without wrapping. Thus, individual packing materials for each roll may be saved while more than 40% of the intermediate and exterior transportation packaging may be saved. More than 470 yuan per ton of the product may be saved on packing. The saving on transportation and packing alone amounts to 0.65 yuan for every U.S., Dollar obtained from export of such toilet rolls—a remarkable economic benefit.

It goes without saying that the same is true with those toilet rolls for domestic consumption. The method disclosed in the present invention will not only bring money-saving results on transportation and storage for the trading enterprises but if the manufacturing factory adds a pressing process in its production line, the money saved by the manufacturer may be passed on to the consumer. Since toilet paper is used in considerable amount by families, people buy it in units of intermediate packages instead of single rolls. Also, since 44% of the space required originally for storing cylindrical rolls is saved, for a family having only a decent size living quarters in such cities as Hong Kong or Tokyo, it is undoubtedly a real benefit. Besides, without the wrapping for each roll and with the increase of toilet paper by the same weight of the wrapping, the useful part of the roll is increased. This lowers the price and makes the product more readily acceptable to consumers.

BEST MODE FOR CARRYING OUT THE INVENTION

Figure 3:
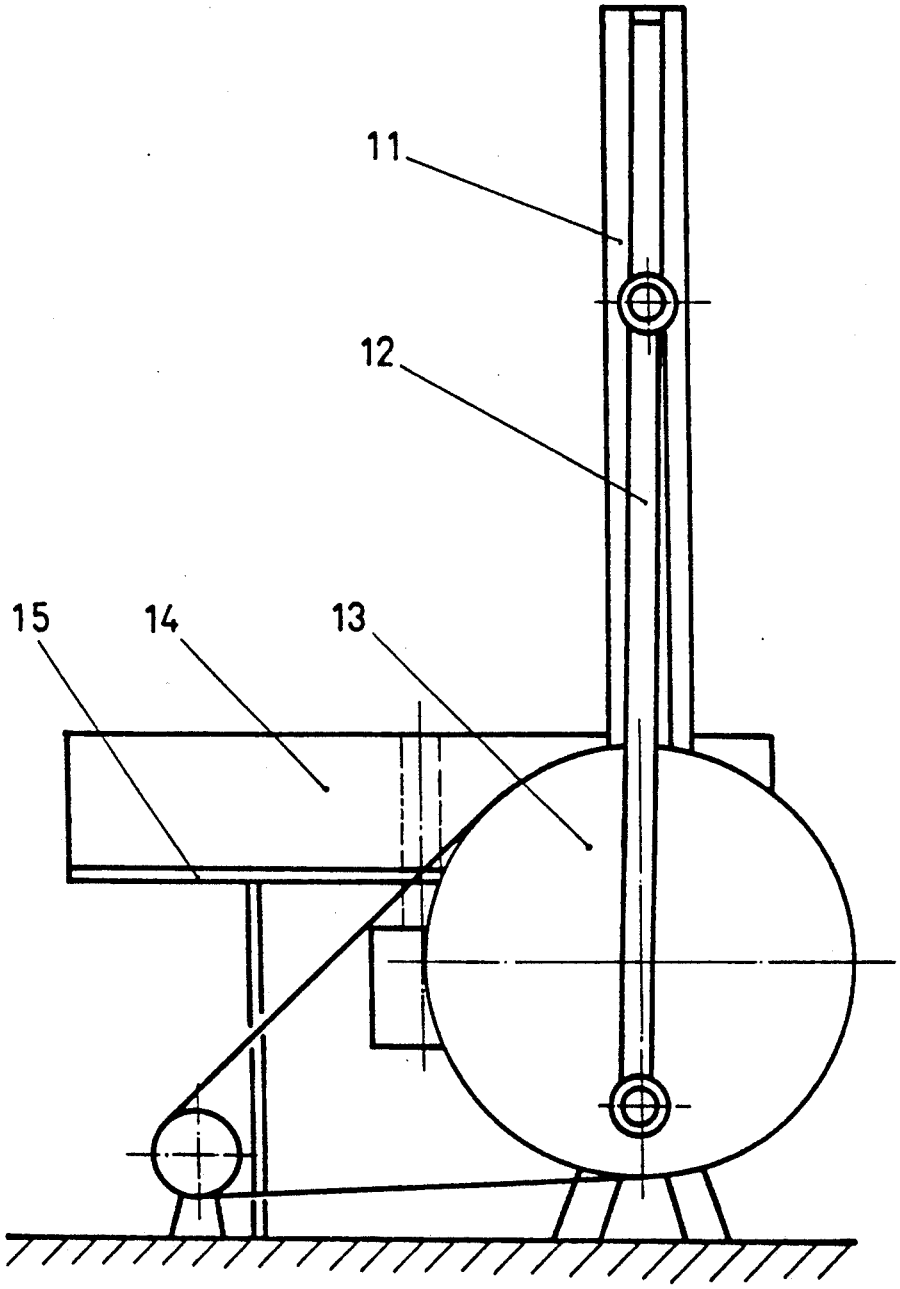
FIG. 3 is a diagrammatic sketch of the pressing and packing machine.
Figure 4:
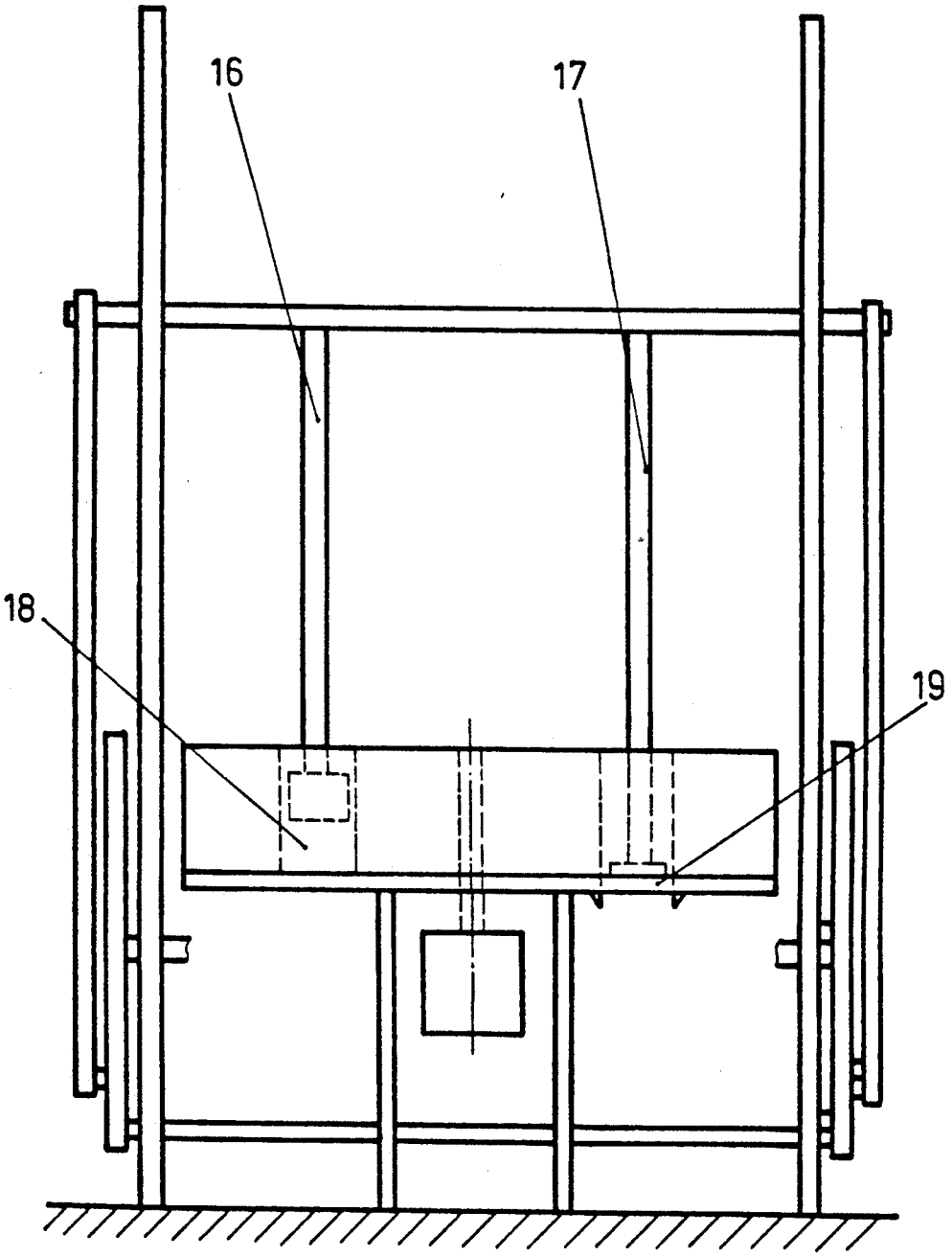
FIG. 4 is a side view of the pressing and packing machine shown in FIG. 3.
Figure 5:
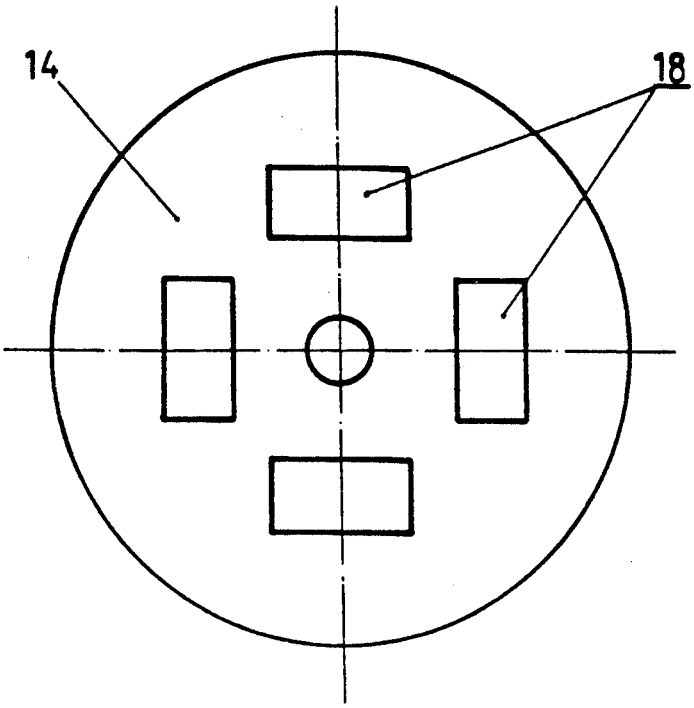
FIG. 5 is a top view of the transforming mould of the pressing and packing machine.

The pressing of toilet rolls can be realized either manually or by machine. If they are pressed mechanically, then a pressing and packing machine will be needed (FIGS. 3, 4 and 5). This pressing and packing machine, apart from power transmission mechanisms, mainly consists of a frame 11, connecting rods 12, flywheels 13, mould 14, table 15, transforming piston 16 and push out piston 17. When the machine works the transforming piston 16 comes down and presses the roll into the desired form and then comes back to its original position. The mould then turns an angle so that slot 18 is now right on top of exit 19 on the table. The push out piston 17 comes down and pushes out the flattened roll into an intermediate packing bag placed under the exit.

Figure 6:
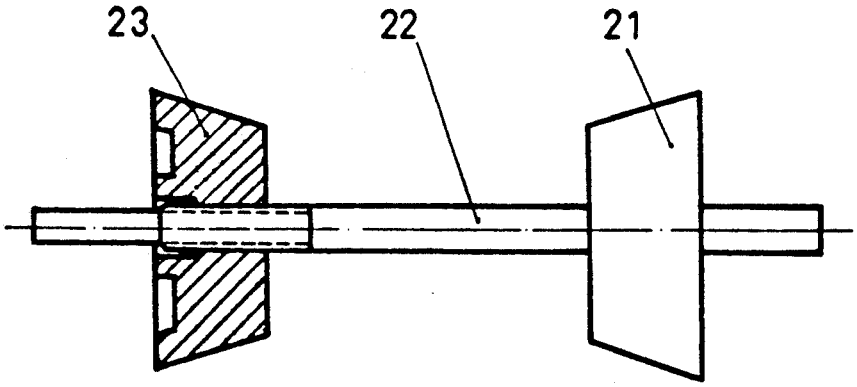
FIG. 6 is a side view, in partial cross-section, of the cylindrical shape recovery device designed in accordance with the present invention.

The production and usage of cylindrical toilet rolls has long been a habit of people, a cylindrical toilet roll no doubt has its merits. Therefore before using the rolls it is necessary to recover the cylindrical form from the pressed form. To recover the original shape, a special cylindrical shape recovery device is needed (FIG. 6). This device, consists of a threaded rod 22 and two conical pieces 21 and 23. Conical piece 21 may be made fixed to the rod 22 and conical piece 23 is actually a conical nut. In the recovery process, the rod is inserted into the flattened core of the toilet roll. Then the conical nut is put on and screwed tight. The toilet roll regains its cylindrical shape as the core is opened up. So the process is actually very simple. Any user can easily accomplish it. This cylindrical shape recovery device is simply a part of application for a patent for utility model CN 88214001 "Hungup Easy-pulling Toilet Paper Holder". If the customer has this kind of holder, he may easily recover the original cylindrical shape of the toilet roll and does not need to spend money in buying one.

EXAMPLE 1

Figure 1:
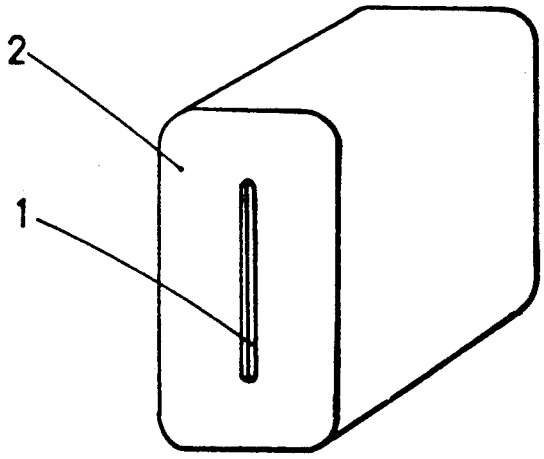
FIG. 1 is a front perspective view illustrating the shape of the toilet roll transformed according to the present invention in the process of transportation and storage.
Figure 2A:
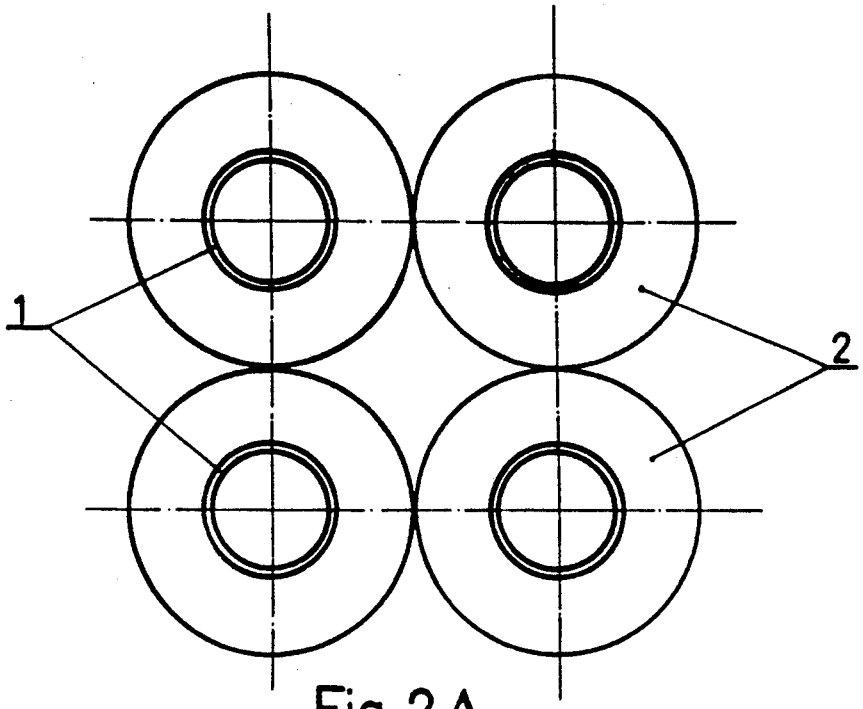
FIG. 2 is a comparison between intermediated packings of transformed and untransformed toilet rolls.
Figure 2B:
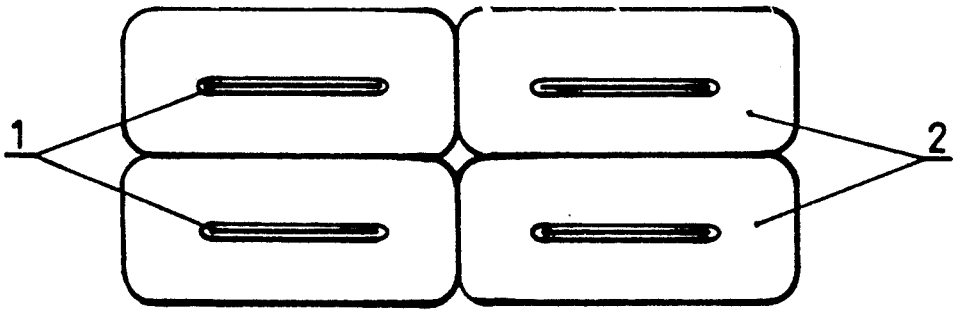

Press the cylindrical shaped toilet rolls, produced by the manufacturer, either manually or by a pressing and packing machine according to the present invention into the shape as shown in FIG. 1 and pack the pressed rolls for transportation and storage.

EXAMPLE 2

The producer reforms his packing process on his production line into a manual or machine pressing and packing process according to the present invention. This process receives naked (without wrapping) cylindrical toilet rolls, presses them into the shape shown in FIG. 1 and then packs them into intermediated and exterior packages ready for transportation and storage. There are trade marks and decoration on intermediate packages so as to increase the good look of the product. This is more economical than having a trade mark on each roll. If a process of mechanical pressing and packing is adopted, a pressing and packing machine according to the present invention is to be installed.

Although certain embodiments of the invention have been described herein in detail, the invention is not to be limited only to such embodiments, but rather only be the appended claims.

What is claimed is:

1. A method for saving space occupied by toilet rolls, each roll including a core formed of a material capable of being flattened, the core having an original cylindrical-shaped periphery and including a first end and a opposing second end, in transportation and storage processes, comprising the steps of:

before transportation and storage, pressing the cylindrical toilet rolls so that the cross section of each roll presents a shape similar to a rectangle and the periphery of the core becomes two flat walls positioned closely adjacent to each other;

transporting the pressed toilet rolls; and when the rolls are to be used, restoring the pressed rolls to their original cylindrical-shape by inserting a threaded rod between the two flat walls of the core, mounting a conical piece on each of opposite ends of said rod with the apex pointed toward said core, and screwing one of said pieces into said core until the periphery of the core has recovered to the original cylindrical-shape.

2. A method according to claim 1, wherein said pressing step is performed by a pressing and packing machine.

3. A method according to claim 1, wherein said pressing step is performed manually.

* * * * *